US009725966B2

(12) United States Patent
Tavner et al.

(10) Patent No.: US 9,725,966 B2
(45) Date of Patent: Aug. 8, 2017

(54) RISER SYSTEM

(75) Inventors: Charles Tavner, Chichester (GB); Martin Peter William Jones, Chichester (GB)

(73) Assignee: Magma Global Limited, Portsmouth (GB)

( * ) Notice: Subject to any disclaimer, the term of this patent is extended or adjusted under 35 U.S.C. 154(b) by 114 days.

(21) Appl. No.: 14/124,812

(22) PCT Filed: Jun. 11, 2012

(86) PCT No.: PCT/GB2012/051317

§ 371 (c)(1), (2), (4) Date: Oct. 8, 2015

(87) PCT Pub. No.: WO2012/168742

PCT Pub. Date: Dec. 13, 2012

(65) Prior Publication Data

US 2016/0138345 A1 May 19, 2016

Related U.S. Application Data

(63) Continuation-in-part of application No. 13/158,100, filed on Jun. 10, 2011, now abandoned.

(30) Foreign Application Priority Data

Jul. 20, 2011 (GB) ..... 1112469.0

(51) Int. Cl.
*E21B 17/01* (2006.01)
*E21B 17/08* (2006.01)

(52) U.S. Cl.
CPC ..... *E21B 17/085* (2013.01); *Y10T 29/49826* (2015.01)

(58) Field of Classification Search
CPC ..... E21B 17/01; E21B 17/085; E21B 17/18
See application file for complete search history.

(56) References Cited

U.S. PATENT DOCUMENTS 3,688,840 A * 9/1972 Curington ..... E21B 33/038 166/341
4,662,785 A * 5/1987 Gibb ..... E21B 17/01 166/341

(Continued)

FOREIGN PATENT DOCUMENTS

WO 99/57413 11/1999
WO 02/072995 9/2002

(Continued)

OTHER PUBLICATIONS

Search Report received in Great Britain Application No. GB1112469.0, dated Oct. 17, 2011.

(Continued)

*Primary Examiner* — Matthew R Buck
(74) *Attorney, Agent, or Firm* — Levy & Grandinetti

(57) ABSTRACT

A riser system configured to be secured between a surface vessel and a subsea location comprises a primary conduit and an auxiliary conduit extending adjacent the primary conduit, wherein the primary and auxiliary conduits are connected together at an axial location along the riser system via a connecting portion. The auxiliary conduit comprises a composite material formed of at least a matrix and one or more reinforcing elements embedded within the matrix.

18 Claims, 9 Drawing Sheets

(56) References Cited

U.S. PATENT DOCUMENTS 5,634,671 A * 6/1997 Watkins ..... E21B 17/085 166/344
5,660,233 A * 8/1997 Sparks ..... E21B 17/01 166/367
6,415,867 B1 * 7/2002 Deul ..... E21B 17/01 166/345
6,615,922 B2 * 9/2003 Deul ..... E21B 17/01 166/345
7,762,337 B2 * 7/2010 Papon ..... E21B 17/085 166/345
8,037,939 B2 * 10/2011 Poirette ..... E21B 17/085 166/339
8,322,438 B2 * 12/2012 Larson ..... E21B 17/012 138/106
8,474,540 B2 * 7/2013 Guesnon ..... E21B 17/085 166/339
8,733,446 B2 * 5/2014 Espinasse ..... E21B 17/012 166/344
2001/0017466 A1 8/2001 Braun
2010/0300699 A1 * 12/2010 Papon ..... E21B 17/01 166/367
2011/0017466 A1 * 1/2011 Averbuch ..... E21B 17/085 166/345
2011/0073315 A1 * 3/2011 Guesnon ..... E21B 17/085 166/367
2012/0037377 A1 * 2/2012 Walker ..... E21B 17/01 166/345
2012/0312544 A1 * 12/2012 Tavner ..... E21B 17/085 166/367

FOREIGN PATENT DOCUMENTS

WO 03/012357 12/2003
WO WO 2008/058209 5/2008
WO 2010/121191 A1 10/2010

OTHER PUBLICATIONS

Partial Search received in corresponding PCT Application No. PCT/GB2012/051317, dated Oct. 15, 2013.
Guesnon, J. et al., "Ultra Deep Water Drilling Riser Design and Relative Technology," Oil & Gas Science and Technology, vol. 57, pp. 39-57 (2002).

* cited by examiner

RISER SYSTEM

FIELD OF THE INVENTION

The present invention relates to a riser system, and in particular to a riser system comprising a primary riser conduit and one or more auxiliary conduits extending adjacent the riser conduit.

BACKGROUND TO THE INVENTION

In the oil and gas industry subsea wellbores are drilled from surface vessels, such as drill ships, semi-submersible rigs, jack-up rigs and the like, as is well known in the art. Typically, a drilling riser is provided which extends between the wellhead and a surface vessel to provide a contained passage for equipment and fluids. To this extent the drilling riser normally includes a large bore central riser pipe which accommodates the drilling equipment and certain fluids, such as drilling fluids and wellbore fluids, and a number of auxiliary conduits which extend alongside the central riser pipe and provide communication of control fluids, well kill fluids, choke fluids, hydraulic power fluid and the like. Such auxiliary lines may terminate at the wellhead, for example at a Blow Out Preventer (BOP) or the like.

The drilling riser is typically formed from a number of individual sections or joints which are secured together in end-to-end relation. Each individual section includes the required auxiliary lines arranged around a length of riser pipe, wherein the ends of the riser pipe and auxiliary lines are terminated at opposing flange connectors. During deployment, the individual sections are secured together via the flange connectors. This arrangement permits the riser pipes and auxiliary lines to be connected and sealed together at a single location to speed up the deployment process.

Known drilling risers are of a metallic construction, typically formed from steel. However, it has been proposed in the art, for example from WO 2010/129191 to provide auxiliary lines composed of aluminium.

During use a drilling riser will be subject to various forces. For example, the drilling riser may be subject to bending loads, for example due to deviation of the drilling vessel relative to the wellhead. As the auxiliary lines are offset from the riser bending axis this can result in significant strains being applied within said lines. Further, such bending may result in the auxiliary lines being subject to different levels of strain. For example, an auxiliary line on one side of the riser pipe may be subject to tension during bending of the riser, whereas an auxiliary line on an opposing side may be subject to compression. Excessive bending may result in tensile forces exceeding yield limits, and compressive forces causing buckling within the effected auxiliary line, the result of which may be permanent plastic deformation and/or catastrophic failure. Such deformation or failure may make disassembly difficult, and may prevent subsequent use of the deformed lines. Additionally, these significant differential strains may expose the flange connectors to adverse load conditions.

Furthermore, the drilling riser must be capable of supporting very large tensile forces, primarily applied by its own weight. As the industry moves to deeper waters such global tension requirements are becoming significant. Also, deeper environments place the drilling riser under increasing hoop forces due to large hydrostatic pressures. To accommodate the applied tensile and hoop forces the riser pipe sections must be of very thick wall construction, increasing the weight of the system. System weight will also increase in greater water depths due to the use of longer riser pipe and auxiliary lines. In some situations the design requirements of the riser may result in a system having a weight which exceeds the operational deckload of conventional drilling vessels.

In certain circumstances a rigid connection may be provided between the central riser pipe and the auxiliary lines, such as is disclosed in, for example, U.S. 2001/0017466, U.S. 2011/0073315 and U.S. 2011/0300609. Under static conditions this arrangement might permit acceptable loads to be transferred between the central riser pipe and the auxiliary lines via the rigid connection. However, under dynamic conditions, which is a very important design consideration, it might be possible for the auxiliary lines to become overloaded due to operational forces. For example, different dimensions of the central riser pipe and auxiliary lines may establish a disproportionate effect on the auxiliary lines due to transient loading, such as increasing axial tension and/or compression. Furthermore, the components of known risers are typically formed from metallic components which exhibit relatively large axial stiffness, and as such the reaction of such metallic components to appreciable dynamic loadings might be undesired. For example, the high axial stiffness of such metallic components may result in yield limits being approached or exceeded with relatively low strain levels. That is, an auxiliary line may approach or exceed failure loads during relatively small deformation events. To address such issues it is often the case that safety measures are introduced which permits relative movement between the central riser pipe and auxiliary lines to be achieved, for example during exposure to elevated loads and deformations.

Furthermore, the assembly of known risers having a rigid connection between a central metallic riser pipe and metallic auxiliary lines may be problematic. For example, it is known to fit metallic auxiliary lines between flanges formed integrally at either end of a central metallic riser pipe. However, due to the tolerances in the dimensions of the metallic auxiliary lines and/or the central metallic riser pipe, misalignment between the metallic auxiliary lines and the central metallic riser pipe may occur. This may, for example, necessitate the use of shims, spacers or similar to compensate for mismatches in axial length between the metallic auxiliary lines and the space between the flanges at either end of the central metallic riser pipe. Consequently, the assembly of known risers having a rigid connection between a central metallic riser pipe and metallic auxiliary lines may be complex and time-consuming.

SUMMARY OF THE INVENTION

An aspect of the present invention may relate to a riser system configured to be secured between a surface vessel and a subsea location, said system comprising:

a primary conduit; and an auxiliary conduit extending adjacent the primary conduit and comprising a composite material formed of at least a matrix and one or more reinforcing elements embedded within the matrix, wherein the primary and auxiliary conduits are connected together at an axial location along the riser system via a connecting portion.

The riser system may comprise or define a drilling riser system. The primary conduit may be configured to accommodate drilling equipment and certain fluids, such as drilling fluids. The auxiliary conduit may be configured to accommodate fluid communication of certain fluids, such as control fluids, well kill fluids or the like between the surface vessel and subsea location.

Both the primary and secondary conduits may be secured relative to a surface vessel.

The riser system may be configured to be secured to a subsea wellhead, for example to a Blow Out Preventer (BOP), a Lower Marine Riser Package (LMRP) or the like.

The primary and auxiliary conduits may be rigidly connected together at or via the connecting portion. Such a rigid connection may prevent or restrict relative movement of the auxiliary and primary conduits in at least one plane or direction at the connecting portion. The auxiliary conduit may be radially secured relative to the primary conduit at or via the connecting portion. That is, relative radial movement of the primary and auxiliary conduits at the connecting portion may be prevented or restricted. The auxiliary conduit may be axially secured relative to the primary conduit at or via the connecting portion. That is, relative axial movement of the primary and auxiliary conduits at the connecting portion may be prevented or restricted.

In some embodiments, rigidly connecting the primary and auxiliary conduits may be such that deflection or deformation of the primary conduit may result in load transference to the auxiliary conduit across the connecting portion which may cause deflection or deformation of the auxiliary conduit. However, forming the auxiliary conduit from a composite material may permit increased levels of strain to be accommodated for reduced levels of stress than conventional metallic conduits such that said auxiliary conduit may be suitably compliant during such periods of deformation, preventing or minimising failure, such as tensile failure, buckling or the like. Thus, additional measures for accommodating deformations in the auxiliary conduits of known riser systems, such as sliding seal assemblies, may not be required.

The composite material may exhibit a higher strain rate to specific stress than an equivalent metallic component. As will be appreciated by those of skill in the art, an equivalent metallic component may be one which defines the same pressure rating as the composite auxiliary conduit. Accordingly, the composite material may permit the auxiliary conduit to satisfactorily accommodate deformation, for example significant deformation, such as may be caused by tensile forces, compressive forces, bending forces, torsional forces and the like.

The composite material may be configured to withstand or permit axial and/or bending strains of up to 6%, up to 4%, up to 2% or up to 1%.

Such permitted strains for the composite material may be significantly larger than a maximum permitted strain for a conventional material such as steel, aluminium or the like. Accordingly, an auxiliary conduit comprising such a composite material may provide a compliant conduit by virtue of the properties of the composite material alone. Thus, the response of the auxiliary conduit to dynamic loading, for example, and events of excessive deformation may become of less concern to a riser designer and operator.

Forming the auxiliary conduit from a composite material may assist to minimise the weight of the system, for example relative to all metal riser systems known in the art. Such weight savings may assist in deployment and retrieval, and may assist to keep the global weight of the riser system within the deckload limits of an associated vessel.

The riser system may be configured such that the auxiliary conduit at least partially supports the weight of the primary conduit. This arrangement may be permitted via the connecting portion. Such an arrangement may generate axial strain within the auxiliary component. However, forming the auxiliary conduit from a composite material may permit increased levels of strain to be accommodated such that said auxiliary conduit may appropriately provide support to the primary conduit. Furthermore, load sharing between the primary and auxiliary conduits may permit the primary conduit to be reduced in size due to a lower requirement to be self-supporting, providing a number of benefits such as weight reduction, cost reduction and the like. Further, in some situations, for example where extremely large pressures and hoop strains must be accommodated, the primary conduit may be increased in size, and thus weight, while the auxiliary conduit contributes to supporting this additional weight.

Load sharing between the primary and auxiliary conduits may be achieved via the connecting portion. For example, the auxiliary conduit may be configured to at least partially support the weight of the primary conduit through the connecting portion.

The auxiliary conduit may be pre-tensioned, for example against or relative to the connecting portion. Such pretension may permit the auxiliary conduit to at least partially support the weight of the primary conduit. The pre-tension may permit the auxiliary conduit to at least partially support the weight of the primary conduits at all times during use. Furthermore, such pre-tension may assist to accommodate increased levels of compression within the auxiliary conduit, which may, for example, be present during bending of the riser system.

Establishing pre-tension within the auxiliary conduit may result in said conduit being exposed to tensile forces at the moment of assembly of the riser system. That is, even when the auxiliary member is under static loading conditions such tensile forces will be present. Accordingly, any axial extension deformation or strain affecting the auxiliary conduit during dynamic loading will result in further tension being applied within the auxiliary conduit. However, due to the composite construction of the auxiliary conduit this eventuality is accepted due to the composite material exhibiting a higher strain rate to specific stress than, for example, an equivalent metallic component. It is understood that in conventional riser arrangements, such as where metallic auxiliary lines are utilised, pre-tensioning is intentionally avoided or minimised where additional tension is expected during use. For example, as metallic components are generally axially stiff, an initial level of pre-tension may minimise the available accommodation of axial extension deformation during dynamic conditions, as stress will increase significantly for very little increase in axial strain.

Establishing pre-tension within the auxiliary conduit, for example against or relative to the connecting portion, may establish pre-compression within the primary conduit. Such pre-compression may permit the primary conduit to support greater levels of tension, such as may be caused by the weight of the riser system and any service loadings. Further, permitting a greater tensile capacity within the primary conduit by virtue of establishing pre-compression may permit a smaller or thinner walled primary conduit to be utilised, contributing towards a weight and material reduction.

In some embodiments the primary and auxiliary conduits may be compliantly connected together at or via the connecting portion. This arrangement may permit a degree of floating of the auxiliary conduit relative to the primary conduit at least in one direction or plane. This may, for example, assist to minimise load transference, which in some embodiments may not be desirable in one or more directions or planes. Such a compliant connection may permit relative movement of the auxiliary and primary conduits in at least one plane or direction at the connecting portion. The auxiliary conduit may be permitted to move radially relative to the primary conduit at the connecting portion. That is, relative radial movement of the primary and auxiliary conduits at the connecting portion may be permitted. The auxiliary conduit may be permitted to move axially relative to the primary conduit at the connecting portion. That is, relative axial movement of the primary and auxiliary conduits at the connecting portion may be permitted.

The primary and secondary conduits may be rigidly connected together in one plane or direction, and compliantly connected together in another plane or direction at or via the connecting portion. For example, the auxiliary conduit may be radially secured relative to the primary conduit at or via the connecting portion, and also may be permitted to move axially relative to the primary conduit at the connecting portion. Such an arrangement may retain the auxiliary conduit within a desired proximity of the primary conduit, while permitting a degree of independent axial movement, or floating, of the auxiliary conduit.

The riser system may comprise a plurality of connecting portions permitting the auxiliary component to be connected relative to the primary conduit at multiple points along the length of the riser system. At least one of the individual connecting portions may define a rigid connection between the primary and auxiliary conduits. Such rigid connection may define one or more load transfer points to permit transference of load between the primary conduit and the auxiliary conduit. At least one of the individual connecting portions may define a compliant connection between the primary and auxiliary conduits.

The auxiliary conduit may be pre-tensioned between two axially spaced connecting portions.

The connecting portion may comprise or be defined by a flanged connection. The connecting portion may comprise a pair of flange components secured together to define a flanged connection.

The riser system may comprise a plurality of auxiliary conduits. The auxiliary conduits may be circumferentially distributed about the primary conduit. Two or more of the plurality of auxiliary conduits may be configured similarly. Two or more of the plurality of auxiliary conduits may be configured differently.

The riser system may comprise a plurality of auxiliary conduits which are evenly circumferentially distributed about the primary conduit. Such an arrangement may be beneficial in embodiments in which the auxiliary conduits are to some degree pre-tensioned relative to the primary conduit. That is, the even distribution of pre-tensioned auxiliary conduits may permit an even global load being applied to the primary conduit. This may prevent or minimise any bending of the primary conduit by such pretension.

The riser system may comprise at least two diametrically opposed auxiliary conduits. Such an arrangement may also be beneficial in embodiments in which the auxiliary conduits are to some degree pre-tensioned relative to the primary conduit. That is, the diametric orientation of the pre-tensioned auxiliary conduits may permit an even global load being applied to the primary conduit to prevent or minimise any bending or the like of the primary conduit by such pretension.

In some embodiments a plurality of auxiliary conduits may be pre-tensioned to different degrees. This may permit a desired uneven loading to be applied to the primary conduit. For example to cause the conduit to adopt a desired shape, to control deformation of the primary conduit, to encourage an expected and repeatable deformation of the primary conduit, or the like.

The primary conduit may be of a larger diameter than the auxiliary conduit. The auxiliary conduit may extend externally of the primary conduit. The auxiliary conduit may extend internally of the primary conduit.

The primary conduit may comprise a metal or metal alloy.

The primary conduit may comprise a composite material formed of at least a matrix and one or more reinforcing elements embedded within the matrix. The primary and auxiliary conduits may comprise a similar composite material construction.

The matrix of one or both of the primary and auxiliary conduits may comprise a polymer material. The matrix of one or both of the primary and auxiliary conduits may comprise a thermoplastic material. The matrix of one or both of the primary and auxiliary conduits may comprise a thermoset material. The matrix of one or both of the primary and auxiliary conduits may comprise a polyaryl ether ketone, a polyaryl ketone, a polyether ketone (PEK), a polyether ether ketone (PEEK), a polycarbonate or the like, or any suitable combination thereof. The matrix of one or both of the primary and auxiliary conduits may comprise a polymeric resin, such as an epoxy resin or the like.

The reinforcing elements of one or both of the primary and auxiliary conduits may comprise continuous or elongate elements. The reinforcing elements of one or both of the primary and auxiliary conduits may comprise any one or combination of polymeric fibres, for example aramid fibres, or non-polymeric fibres, for example carbon, glass or basalt elements or the like. The reinforcing elements of one or both of the primary and auxiliary conduits may comprise fibres, strands, filaments, nanotubes or the like. The reinforcing elements of one or both of the primary and auxiliary conduits may comprise discontinuous elements.

The matrix and the reinforcing elements of one or both of the primary and auxiliary conduits may comprise similar or identical materials. For example, the reinforcing elements may comprise the same material as the matrix, albeit in a fibrous, drawn, elongate form or the like.

The connecting portion may comprise a metal or metal alloy.

The connecting portion may comprise a composite material formed of at least a matrix and one or more reinforcing elements embedded within the matrix. The connecting portion and auxiliary conduit may comprise a similar composite material construction.

The riser system may comprise a continuous auxiliary conduit along the length of the riser system. For example, the auxiliary conduit may be provided as a unitary component. In such an arrangement the auxiliary conduit may be deployed from a spool, directly as it is manufactured, or the like.

The riser system may comprise a modular auxiliary conduit. The auxiliary conduit may comprise a plurality of discrete auxiliary conduit sections secured together in end-to-end relation along the length of the riser system. Such a modular arrangement may assist in deployment and/or retrieval of the riser system, for example.

Adjacent discrete auxiliary conduit sections may be secured relative to each other in end-to-end relation to define a continuous auxiliary conduit. Adjacent discrete auxiliary conduit sections may be secured relative to each other in the region of the connecting portion. Adjacent discrete auxiliary conduit sections may be secured relative to each other at least in part by the connecting portion.

Adjacent discrete auxiliary conduit sections may be secured relative to each other at a region which is remote from the connecting portion.

A discrete auxiliary conduit section may be installed within the system by being axially inserted into or through one or more connecting portions.

A discrete auxiliary conduit section may be deformed, for example by longitudinal bending, to define a reduced axial envelope and then located between two connecting portions and subsequently relaxed to become secured or located between said connecting portions. In such an arrangement the composite material of the auxiliary conduit section may permit such longitudinal bending to be achieved without causing damage or creating significant stress within the conduit, and also permit substantially complete elastic recovery when relaxed during insertion between the connecting portions.

Adjacent discrete auxiliary conduits may be rigidly secured together. Adjacent discrete auxiliary conduit sections may be rigidly secured together in at least one plane or direction. Adjacent discrete auxiliary conduit sections may be rigidly secured together in an axial direction. That is, relative axial movement of adjacent auxiliary conduit sections may be restricted or prevented at the region of connection therebetween.

Adjacent discrete auxiliary conduit sections may be compliantly secured together, for example in at least one plane or direction. Adjacent discrete auxiliary conduit sections may be compliantly secured together in an axial direction. That is, relative axial movement of adjacent auxiliary conduit sections may be permitted at the region of connection therebetween. Such a compliant connect may minimise the transference of load between different auxiliary conduit sections.

The riser system may comprise an interface assembly.

The interface assembly may be configured to facilitate connection between the auxiliary and primary conduits at the connecting portion.

The interface assembly may be configured to permit adjacent discrete auxiliary conduit sections to be secured relative to each other at or remotely from the connecting portion. The interface assembly may provide a rigid connection. The interface assembly may provide a compliant connection.

The interface assembly may be provided separately from the connecting portion. The interface assembly may be configured to be secured relative to the connecting portion. Such an arrangement may permit connection of the primary and auxiliary conduits to be achieved via both the connecting portion and the interface assembly. The interface assembly may be configured to be rigidly secured relative to the connecting portion. The interface assembly may be secured relative to the connecting portion by, for example, bolting, interference fitting, clamping, threaded connection or the like. The interface assembly may be configured to be compliantly secured relative to the connecting portion.

The interface assembly may comprise a unitary component to which adjacent discrete auxiliary conduit sections are secured.

The interface assembly may comprise separate components which are respectively secured or otherwise associated with adjacent auxiliary conduit sections and secured or connected relative to each other to provide connection between said auxiliary conduit sections. The separate components may be directly secured relative to each other. The separate components may be indirectly secured relative to each other. The separate components may be indirectly secured relative to each other via the connecting portion.

The interface assembly may permit connection between at least one discrete auxiliary conduit section and the connecting portion.

At least a portion of the interface assembly may be defined by or form part of the connecting portion. For example, the connecting portion may include one or more components to which one or adjacent discrete auxiliary conduit sections may be secured. The connecting portion may entirely define the interface assembly.

At least a portion of the interface assembly may be defined by or form part of one or both adjacent auxiliary conduit sections. For example, an end region of one or both adjacent auxiliary conduit portions may define at least a portion of the interface assembly.

The interface assembly may comprise a telescoping arrangement. For example, a discrete auxiliary conduit section may be secured to the interface assembly in a telescoping manner. Such a telescoping arrangement may provide an axially compliant connection. The interface assembly may comprise a spigot portion configured to be engaged internally or externally of an auxiliary conduit section in a telescoping manner. A sealing arrangement, such as one or more sliding seals, o-rings or the like may be provided between the spigot portion and the auxiliary conduit section. The spigot portion may be provided on a component which is separate from either of adjacent auxiliary conduit sections. The spigot portion may be defined by or be provided on one of a pair of adjacent auxiliary conduit sections. In such an arrangement, an end region of one auxiliary conduit section may be received within the end region of an adjacent auxiliary conduit section.

Adjacent discrete auxiliary conduit sections may be mechanically secured relative to the interface assembly. Adjacent discrete auxiliary conduit sections may be fluidly coupled to the interface assembly.

The interface assembly may permit an end region of one discrete auxiliary conduit section to directly engage an end region of an adjacent discrete auxiliary conduit section. Such engagement may occur at the location of the connecting portion. For example, adjacent discrete auxiliary conduits may extend through or into the connecting portion to be engaged with each other.

The interface assembly may permit end regions of adjacent discrete auxiliary conduits to terminate remotely from each other, for example at separate regions of the connecting portion. In such an arrangement the connecting portion may be interposed between respective end regions of adjacent discrete auxiliary conduits. The connecting portion may define an interface conduit portion, for example provided by a bore, sleeve or the like, configured to provide fluid communication between said adjacent discrete auxiliary conduits.

The interface assembly may comprise a releasable arrangement configured to permit release and optionally reconnection of an auxiliary conduit or discrete auxiliary conduit section. The interface assembly may comprise or define a releasable connector, such as a stab-in type connector, collet-type connector or the like.

The interface assembly may be configured to establish tension within an associated auxiliary conduit or discrete auxiliary conduit section. For example, the interface assembly may provide a degree of adjustment to apply tension within an associated auxiliary conduit or discrete auxiliary conduit section. Such adjustment may be provided by a threaded arrangement or the like.

The use of an auxiliary conduit comprising a composite material may simplify the assembly of the riser system because such an auxiliary conduit may accommodate greater deformation than an equivalent metallic component. The use of such an auxiliary conduit may avoid any requirement to use shims, spacers or the like to accommodate any misalignment between the primary conduit, the auxiliary conduit and/or the connecting portion. The use of such an auxiliary conduit may, in particular, avoid any requirement to use shims, spacers or the like to accommodate any axial separation between the connecting portion and an end of the auxiliary conduit. The use of such an auxiliary conduit may, therefore, simplify the assembly of the riser system. The auxiliary conduit may comprise an interface portion configured to mechanically engage the interface assembly. A discrete auxiliary conduit section may comprise an interface portion configured to mechanically engage the interface assembly. In some embodiments the interface portion may form part of the interface assembly. In some embodiments the interface portion may be provided separately from the interface assembly. The interface portion may facilitate securing of the auxiliary conduit, and/or discrete auxiliary conduit section to the interface assembly via mechanical fasteners, such as bolts or the like. In such an arrangement the interface portion may comprise one or more holes for receiving one or more mechanical fasteners.

The interface portion of the auxiliary conduit or discrete auxiliary conduit section may define a thread configured for threaded engagement with the interface assembly.

The interface portion of the auxiliary conduit or discrete auxiliary conduit section may define a profile configured to engage a corresponding profile formed on or within the interface assembly. The profiled interface pardon may comprise a wedge shaped profile, for example. The profiled interface portion may comprise a region of increased outer diameter relative to the auxiliary conduit portion.

The interface portion may define a profile configured to be captivated by the interface assembly.

The interface portion may be integrally formed with the auxiliary conduit or discrete auxiliary conduit section. Alternatively, the interface portion may be separately formed and subsequently secured to the auxiliary conduit or discrete auxiliary conduit section.

The interface pardon may comprise a composite material formed of at least a matrix and one or more reinforcing elements embedded within the matrix. The interface portion may be formed integrally with or may comprise an end region of the auxiliary conduit or discrete auxiliary conduit section. The interface portion may permit an end face of the auxiliary conduit or discrete auxiliary conduit section to extend through the conduit connecting portion and engage, for example directly or indirectly, an end face of a further auxiliary conduit or discrete auxiliary conduit section.

The interface portion may comprise a flange.

The riser system may comprise a plurality of interface assemblies axially distributed along said system. Axially adjacent interface assemblies may be configured to establish tension within an auxiliary conduit or a discrete auxiliary conduit section which extends therebetween.

The riser system may comprise a continuous primary conduit along the length of the riser system. For example, the primary conduit may be provided as a unitary component. In such an arrangement the primary conduit may be deployed from a spool, directly as it is manufactured, or the like.

The riser system may comprise a modular primary conduit. The primary conduit may comprise a plurality of discrete primary conduit sections secured together in end-to-end relation along the length of the riser system. Individual discrete primary conduit sections may be secured together at or via the connecting portion. In other embodiments individual discrete primary conduit sections may be secured together remotely from the connecting portion.

The riser system may comprise a plurality of riser joint sections coupled together in end-to-end relation. Each riser joint section may comprise a section of primary conduit and a section of auxiliary conduit coupled together via one or more corresponding connecting portions. In one embodiment each riser joint section may comprise a connecting portion at each end, wherein the associated primary and auxiliary conduit sections extend between the respective connecting portions. Adjacent riser joint sections may be secured together via respective connecting portions.

The connecting portion may be integrally formed with the primary conduit. In an alternative embodiment the connecting portion may be separately formed and subsequently secured to the primary conduit, for example via mechanical fasteners, a stab-in type connector, welding, melding or the like.

The connecting portion may be integrally formed with the auxiliary conduit. In an alternative embodiment the connecting portion may be separately formed and subsequently secured to the auxiliary conduit, for example via mechanical fasteners, a stab-in type connector, welding, melding or the like.

At least the auxiliary conduit may comprise a variation along its length. For example, at least one axial portion of the auxiliary conduit may vary relative to a different axial portion. Such an arrangement may permit the auxiliary conduit to be more appropriate tailored to a specific use.

At least the auxiliary conduit may comprise a variation in axial load carrying capacity or specification along its length. For example, an upper region of the auxiliary conduit may be configured to accommodate greater axial load than a lower region of the auxiliary conduit. This may permit the upper region of the auxiliary conduit to be more suited to a requirement to carry a greater proportion of the system weight that the lower region. Such variation in axial load carrying capacity may be achieved by a variation in wall thickness, a variation in material, a variation in the make-up of the composite material or the like. Such a variation may be achieved along the length of a single conduit or conduit section. Such a variation may be achieved between different or individual conduit sections.

At least the auxiliary conduit may comprise a wall comprising the composite material, wherein the wall comprises or defines a local variation in construction to provide a local variation in a property of the auxiliary conduit.

Such a local variation in a property of the auxiliary conduit may permit tailoring of a response of the auxiliary conduit to given load conditions.

The local variation in construction may comprise at least one of a circumferential variation, a radial variation and an axial variation in the riser material and/or the auxiliary conduit geometry.

The local variation in construction may comprise a local variation in the composite material.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of the auxiliary conduit. For example, an element provided at a 0 degree alignment angle will run entirely longitudinally of the auxiliary conduit, and an element provided at a 90 degree alignment angle will run entirely circumferentially of the auxiliary conduit, with elements at intermediate alignment angles running both circumferentially and longitudinally of the auxiliary conduit, for example in a spiral or helical pattern.

The local variation in the alignment angle may include elements having an alignment angle of between, for example, 0 and 90 degrees, between 0 and 45 degrees or between 0 and 20 degrees.

At least one portion of the auxiliary conduit wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the auxiliary conduit, and which pre-stress is at least partially or residually retained within the manufactured auxiliary conduit. A local variation in reinforcing element pre-stress may permit a desired characteristic of the auxiliary conduit to be achieved, such as a desired bending characteristic. This may assist to position or manipulate the auxiliary conduit, for example during installation, retrieval, coiling or the like. Further, this local variation in reinforcing element pre-stress may assist to shift a neutral position of strain within the auxiliary conduit wall, which may assist to provide more level strain distribution when the auxiliary conduit is in use, and/or for example is stored, such as in a coiled configuration.

In embodiments where the primary conduit comprises a composite material, similar constructional variations to those described above in relation to the auxiliary conduit may also apply to the primary conduit.

A further aspect of the present invention may relate to a method of forming a riser system to be secured between a surface vessel and a subsea location, comprising:

providing a primary conduit;

extending an auxiliary conduit adjacent the primary conduit, wherein the auxiliary conduit comprises a composite material formed of at least a matrix and one or more reinforcing elements embedded within the matrix; and connecting the primary and auxiliary conduits together at an axial location along the riser system via a connecting portion.

The method may comprise tensioning the auxiliary conduit.

Such a method may simplify the assembly of the riser system because an auxiliary conduit comprising a composite material may accommodate greater deformation than an equivalent metallic component.

Such a method may avoid any requirement to use shims, spacers or the like to accommodate any misalignment between the primary conduit, the auxiliary conduit and/or the connecting portion. Such a method may, in particular, avoid any requirement to use shims, spacers or the like to accommodate any axial separation between the connecting portion and an end of the auxiliary conduit. Such a method may, therefore, simplify the assembly of the riser system.

A further aspect of the present invention may relate to a riser system joint for use in forming a riser system, comprising:

a section of primary conduit;

a section of auxiliary conduit extending adjacent the primary conduit and comprising a composite material formed of at least a matrix and one or more reinforcing elements embedded within the matrix; and at least one connecting portion for connecting together the primary and auxiliary conduits.

The riser joint may comprise a connecting portion at opposing ends of the riser joint, wherein the primary conduit and auxiliary conduit extend between said connecting portions.

Another aspect of the present invention may relate to a riser system comprising a plurality of riser system joints according to any other aspect defined herein.

A connecting portion may be located at one end of the riser system joint.

A connecting portion may be provided at opposite ends of the joint.

At least the auxiliary conduit may be pre-tensioned between the end connecting portions. This arrangement may permit the auxiliary conduit to share loading applied by or through the primary conduit when in use, for example when installed to form part of a riser system.

Another aspect of the present invention may relate to a conduit system comprising:

a primary conduit; and an auxiliary conduit extending adjacent the primary conduit and comprising a composite material formed of at least a matrix and one or more reinforcing elements embedded within the matrix, wherein the primary and auxiliary conduits are connected together at an axial location along the conduit system via a connecting portion.

A further aspect of the present invention may relate to a riser system configured to be secured between a surface vessel and a subsea location, said system comprising:

a primary conduit; and an auxiliary conduit extending adjacent the primary conduit and comprising a composite material formed of at least a matrix and one or more reinforcing elements embedded within the matrix.

Another aspect of the present invention may relate to a compliant connector or interface assembly for connecting first and second conduits in end-to-end relation, comprising:

a retaining portion configured to be retained relative to a separate structure;

first and second tubular portions arranged on opposing sides of the retaining portion and each configured to be received within, or receive, an end region of a respective one of first and second conduits, wherein at least one of the first and second tubular portions is configured to permit relative axial movement with a respective conduit.

Such relative axial movement may be in the form of a telescoping movement.

Both of the first and second tubular portions may be configured to permit relative axial movement with the respective conduits.

The compliant connector of interface assembly may be provided for use in connecting together adjacent discrete conduits of a riser system, such as the riser system defined above.

The retaining portion may be configured to be secured relative to a connecting portion, such as a flanged connecting portion of a riser system.

Another aspect of the present invention may relate to a method of forming a riser system, comprising:

providing a primary conduit having first and second axially separated connecting portions;

deforming an auxiliary conduit to define a reduced axial envelope length which is less than the axial separation of the connecting portions, wherein the auxiliary conduit comprises a composite material formed of at least a matrix and one or more reinforcing elements embedded within the matrix;

locating the deformed auxiliary conduit intermediate the connecting portions;

and relaxing deformation of the auxiliary conduit to permit said conduit to be retained between said connecting portions.

The method may comprise installing multiple auxiliary conduit sections between multiple adjacent connecting portions.

The method may comprise connecting together multiple conduit sections in end-to-end relation, for example using an interface assembly or the like.

It should be understood that features presented in accordance with one aspect may be provided in combination with or in accordance with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
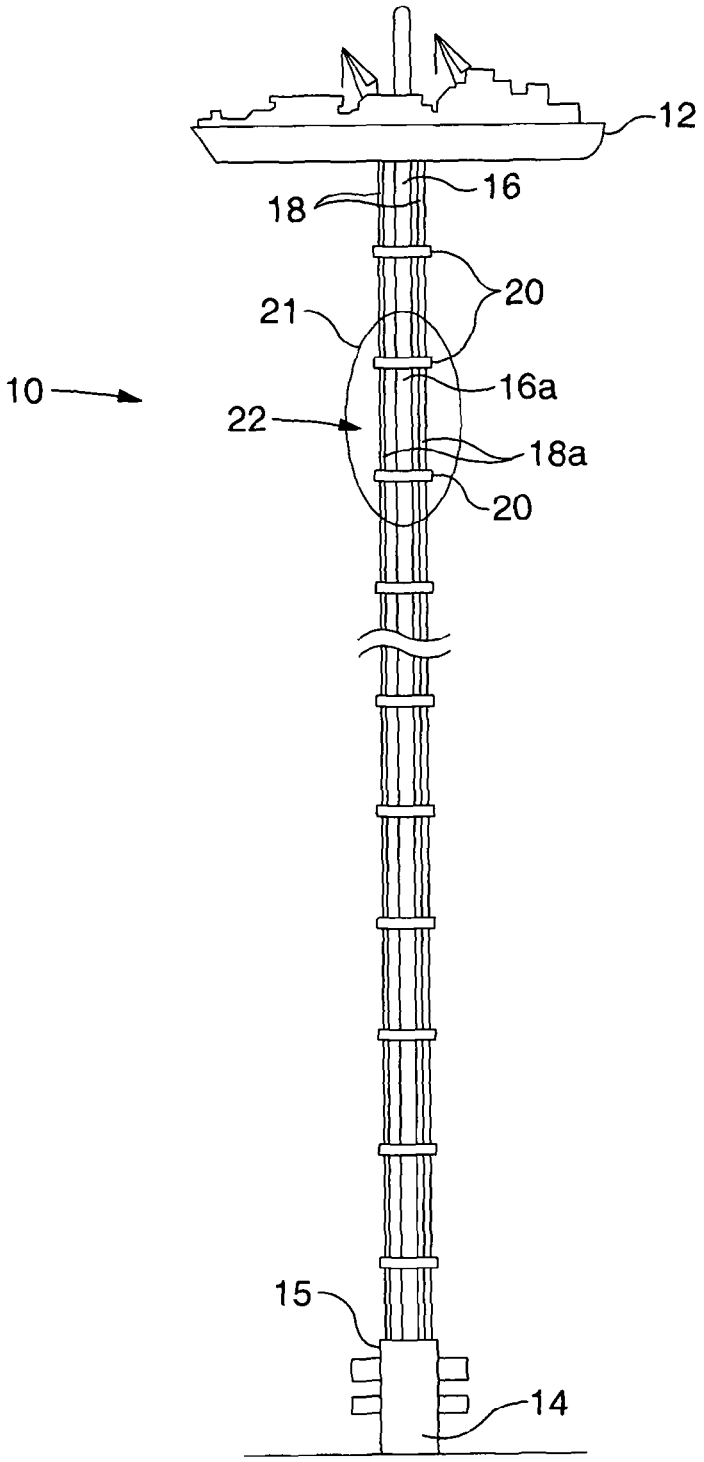
FIG. 1 is a diagrammatic illustration of a drilling riser system in accordance with an aspect of the present invention.

A riser system, generally identified by reference numeral 10, in accordance with an embodiment of the present invention is illustrated in FIG. 1. The riser system may be for any appropriate use. However, for the purposes of the present example the riser system is a drilling riser system. The riser system 10 extends between a surface vessel 12, which in the present embodiment is a drilling ship, and a subsea wellhead 14 (which may include a BOP 15). The drilling riser system 10 comprises a central large bore primary conduit 16 and a plurality of smaller auxiliary conduits 18 which are circumferentially distributed around the primary conduit 16. The auxiliary conduits 18 are mechanically and rigidly secured to the primary conduit at or via a plurality of axially arranged connecting portions 20. In use, the primary conduit 16 accommodates drilling equipment and certain fluids, such as drilling mud and the like, whereas the auxiliary conduits 18 accommodate the communication of other fluids between the surface vessel 12 and the wellhead 14. Such other fluids may include well kill fluids, purge fluids, choke fluids, control fluids for operation of subsea or wellbore equipment, such as the BOP 15 and the like.

Figure 2:
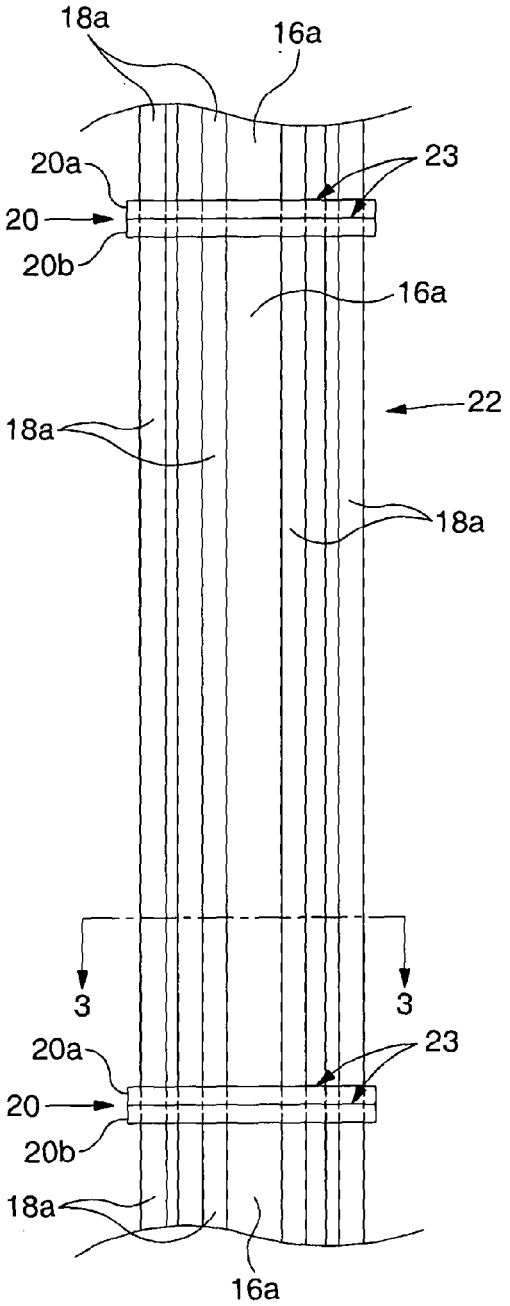
FIG. 2 is an enlarged view of a portion of the drilling riser system of FIG. 1.
Figure 3:
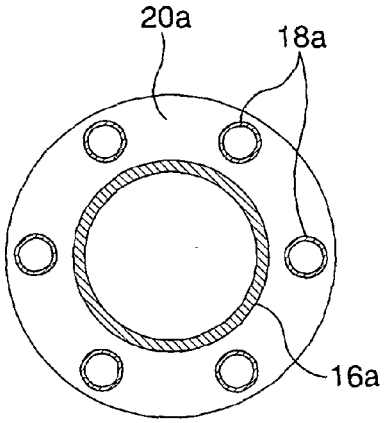
FIG. 3 is a lateral cross-sectional view of the drilling riser system taken through line 3-3 in FIG. 2.

Reference is now additionally made to FIGS. 2 and 3, wherein FIG. 2 is an enlarged view in the region 21 of FIG. 1, and FIG. 3 is a lateral cross-sectional view taken through line 3-3 of FIG. 2.

The riser system 10 is formed from a plurality of individual riser joints 22 which are secured together in end-to-end relation via the connecting portions 20. Each joint 22 includes a discrete primary conduit section 16*a* and a plurality of discrete auxiliary conduit sections 18*a*. Opposite ends of each joint 22 include a respective flange component 20*a*, 20*b* to which the primary conduit section 16*a* and auxiliary conduit sections 18*a* are rigidly secured. As will be described below, such a rigid connection between the conduit sections 16*a*, 18*a* results in load transference therebetween. In some circumstances this may permit the auxiliary conduits 18 to support some of the weight of the primary conduit 16.

With particular reference to FIG. 2, the flange components 20*a*, 20*b* of adjacent joints 22 are secured together, for example by bolts (not shown) to establish a rigid connection between the individual joints 22 at a connecting portion 20. The individual flange components 20*a*, 20*b* of each connecting portion 20 may establish both mechanical and fluid connection between the individual primary and auxiliary conduit sections 16*a*, 18*a*. Although flange-type connectors are illustrated, other types of connection may be possible to secure the individual joints 22 together, such as bayonet type fittings, stab-in type fittings, threaded fittings, clamped fitting or the like.

Each adjacent auxiliary conduit section 18*a* is connected together at the connecting portion via respective interface assemblies 23, wherein in the present embodiment the interface assemblies 23 provide a rigid connection between respective pairs of adjacent auxiliary conduit sections 18*a*. Example embodiments of such interface assemblies 23 will be described later below. In the present embodiment such interface assemblies 23 are provided at the region of the connecting assembly 20. However, in other embodiments an interface assembly may be provided remotely from the connecting portion 20, such that connection of at least two discrete auxiliary conduits need not exist at a connecting portion 20.

In the present invention at least one and in some embodiments all of the auxiliary conduits 18 comprise or are formed from a composite material of at least a matrix and one or more reinforcing elements embedded within the matrix. As will be described in detail below, composing the auxiliary conduits 18 of a composite material provides significant advantages over known arrangements, for example in arrangements in which metallic auxiliary lines are utilised.

In the present embodiment the primary conduit 16 may be formed of a metallic material. However, in other embodiments the primary conduit 10 may be formed of a composite material. Also, in the present embodiment the connecting portions 20 may be formed of a metallic material. However, in other embodiments at least one of the connecting portions 20 may be formed of a composite material.

Figure 4A:
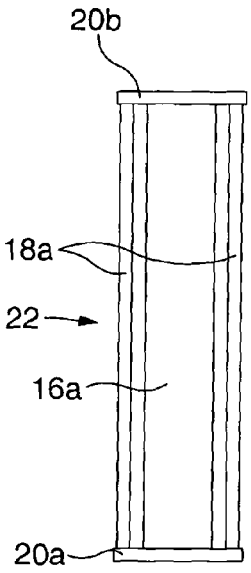
FIG. 4A is an illustration of an individual joint of the drilling riser system shown in an unloaded configuration.
Figure 4B:
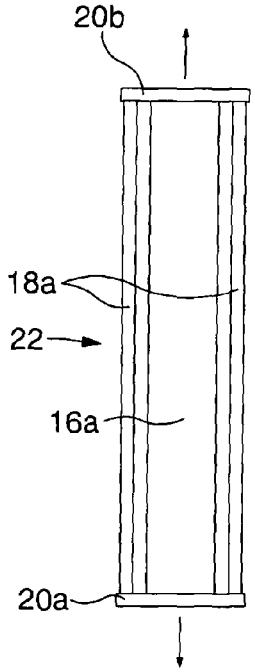
FIG. 4B is an illustration of the individual joint of FIG. 4A exposed to axial tension.
Figure 4C:
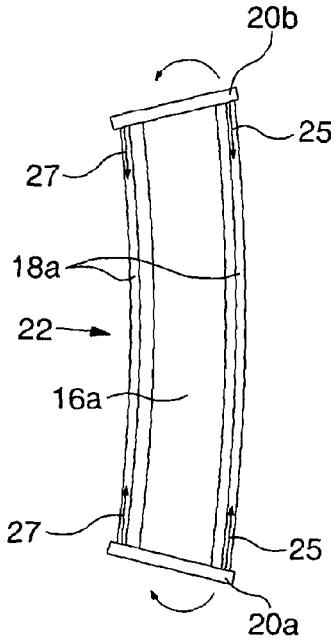
FIG. 4C is an illustration of the individual joint of FIG. 4A exposed to axial bending.

The riser system 10 will be subject to various operational loads during use, which are illustrated with respect to FIGS. 4A to 4C. In FIG. 4A a single riser joint 22 is illustrated in an unloaded configuration. During use, the joint 22 may be subject to significant tension, as illustrated in FIG. 4B, which may be generated by the weight of the riser system 10 (in increasing water depths the weight of the system can be significant). As the primary and auxiliary conduit sections 16*a*, 18*a* are rigidly secured relative to the flange components 20*a*, 20*b*, such tensile forces will generate axial strain within these conduit sections 16*a*, 18*a*, as illustrated in an exaggerated manner in FIG. 4B.

Also during use the joint 22 may be subject to bending, as illustrated in FIG. 4C. Due to the rigid connection of the primary and auxiliary conduit sections 16*a*, 18*a* via the flange components 20*a*, 20*b*, and because the auxiliary conduit sections 18*a* are located offset from the longitudinal bending axis, opposing auxiliary conduit sections 18*a* will be exposed to different levels of strain. That is, one auxiliary conduit may be subject to axial tension, as illustrated by arrows 25, whereas an opposing auxiliary conduit may be subject to axial compression as illustrated by arrows 27.

The present invention may permit such strains during load transference between the primary and auxiliary conduits 16, 18 to be accommodated by forming the auxiliary conduit from a composite material. That is, the use of a composite material may permit increased levels of strain to be accommodated such that the auxiliary conduits may be suitably compliant during such periods of deformation, preventing or minimising failure, such as tensile failure, buckling or the like. More specifically, the composite material may exhibit a higher strain rate to specific stress than an equivalent metallic component. Accordingly, the composite material may permit the auxiliary conduits 18 to satisfactorily accommodate deformation, such as may be caused by tensile forces, compressive forces, bending forces, torsional forces and the like. The composite material of the auxiliary conduits 18 may be configured to withstand or permit axial and/or bending strains of up to 6%, up to 4%, up to 2% or up to 1%. Such maximum permitted strains for the composite material may be significantly larger than a maximum permitted strain for a conventional material such as steel, aluminium or the like. Accordingly, an auxiliary conduit 18 comprising such a composite material may provide a compliant conduit by virtue of the properties of the composite material alone. This may reduce or eliminate the requirement for additional measures to protect the auxiliary conduits from excessive strains.

The composite material of the auxiliary conduits 18 may provide an inherent increase in elastic recovery properties. Accordingly, any deformation, such as buckling, while under load may only be temporary. This may assist in maintaining the auxiliary conduits in a non-deformed state when in a no-load condition, which may assist in handling, disassembly and re-use of the auxiliary conduits, for example.

Increasing water depths will also expose the riser system 10 to increasing pressures, such as hydrostatic pressures, which will typically be manifested as hoop strain within the conduits 16, 18 of the riser system 10. The requirement to accommodate pressure originating loading, and axial loading such as tension and compression, may necessitate the use of very thick-walled conduits, which in turn may add significantly to the weight of the entire system. In some cases such design requirements may result in the operational capacity of the vessel 12 (FIG. 1) being exceeded.

Further, differential strain applied to different auxiliary members 18 may place significant loading, particularly bending, on the connecting portions 20. Providing auxiliary conduits 18 composed of composite material may allow a larger strain rate to specific stress within the auxiliary conduits, permitting greater axial extension of said conduits and thus assisting to protect the connecting portions 20.

Furthermore, forming the auxiliary conduits 18 from a composite material may assist to minimise the weight of the system, for example relative to all metal riser systems known in the art. This may permit thicker-walled conduit sections to be utilised without exceeding weight limits, such as may be dictated by the surface vessel 12.

As described above and illustrated in the drawings, in the exemplary embodiment the primary and auxiliary conduit sections 16*a*, 18*a* of a riser joint 22 are rigidly secured between respective flange components 20*a*, 20*b*. In the present exemplary embodiment one or more of the auxiliary conduit sections 18*a* are connected to the respective flange components 20*a*, 20*b* (via appropriate interface assemblies 23 or components thereof) such that a pretension is applied within the auxiliary conduit section 18*a*. Such a pre-tension arrangement is illustrated with respect to FIGS. 5A and 5B.

Figure 5A:
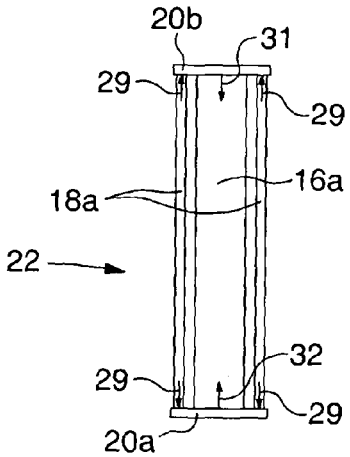
FIG. 5A is an illustration of an individual joint of the drilling riser shown in a pre-stressed configuration.
Figure 5B:
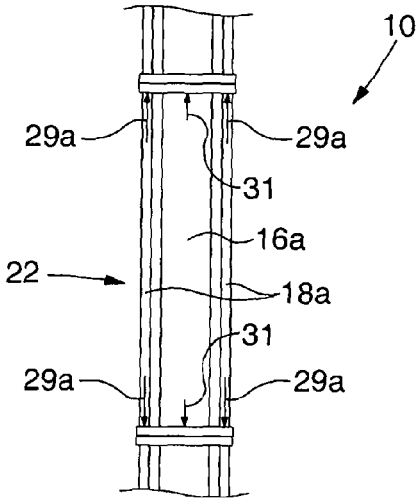
FIG. 5B is an illustration of the individual joint of FIG. 5A shown in use.

FIG. 5A illustrates a single pre-stressed riser joint 22 prior to installation within the riser system 10, wherein pretension within the auxiliary conduit sections 18*a*, illustrated by arrows 29, is established between the flange components 20*a*, 20*b*. Due to the rigid connection between the auxiliary conduit sections 18*a* and the primary conduit section 16*a*, this pre-tension establishes a degree of pre-compression within the primary conduit section 16*a*, as illustrated by arrows 31. When the pre-stressed riser joint 22 is installed within the riser system 10 as illustrated in FIG. 5B, the joint 22 will become exposed to global tensile loading due to the weight of the system 10 below said joint 22. This global tension will establish further tension and thus strain within the auxiliary conduit sections 18*a*, as illustrated by larger arrows 29*a*. However, forming the auxiliary conduits 18 from a composite material will permit such increased levels of strain to be accommodated. Further, as the primary conduit section 16*a* is initially pre-compressed, this section 16*a* may only be exposed to a significantly lower degree of tension, as illustrated by smaller arrows 31*a*, thus providing protection to the primary conduit section 16*a*.

As suggested above, any additional axial extension deformation or strain affecting the auxiliary conduit sections 18*a*, for example due to the global weight of the assembled riser 10 or during dynamic loading, will result in further tension being applied within the auxiliary conduit section 18*a*. However, due to the composite construction of the auxiliary conduit sections 18*a* this eventuality is accepted due to the composite material exhibiting a higher strain rate to specific stress than, for example, an equivalent metallic component. It is understood that in conventional riser arrangements, such as where metallic auxiliary lines are utilised, pre-tensioning is intentionally avoided or minimised where additional tension is expected during use. For example, as metallic components are generally axially stiff, an initial level of pre-tension may minimise the available accommodation of axial extension deformation during dynamic conditions, as stress will increase significantly for very little increase in axial strain.

The pre-tension within the auxiliary conduits 18*a* may effectively permit the auxiliary conduits 18 to share some of the axial loading within the riser system 10 with the primary conduit 16. That is, pre-tensioned auxiliary conduits 18 may function to support at least a portion of the weight of the primary conduit 16. Such an arrangement may permit the primary conduit 16 to be reduced in size, providing a number of benefits such as weight reduction, cost reduction and the like.

Pre-tension within the auxiliary conduit sections 18*a* may be selected such that load sharing with the primary conduit is achieved at all times during use. As such, even in the event of dynamic loading the primary conduit 16 will always be structurally assisted in accommodating the applied loads.

Providing a pre-tension within one or more of the auxiliary conduits 18 may also provide protection to the auxiliary conduit 18 during compression thereof. That is, an deformation which would normally result in compression will be initially absorbed by relaxation of the pretension and corresponding strain.

Providing a pre-tension may also provide benefits during bending of the riser system, such as illustrated in FIG. 4C. For example, the composite material may permit a pretension to be achieved within the auxiliary conduits 18 which is of a sufficient magnitude that even under the bending condition as in FIG. 4C all auxiliary conduits 18 always remain in tension. This may prevent any state of compression from occurring.

Figure 6:
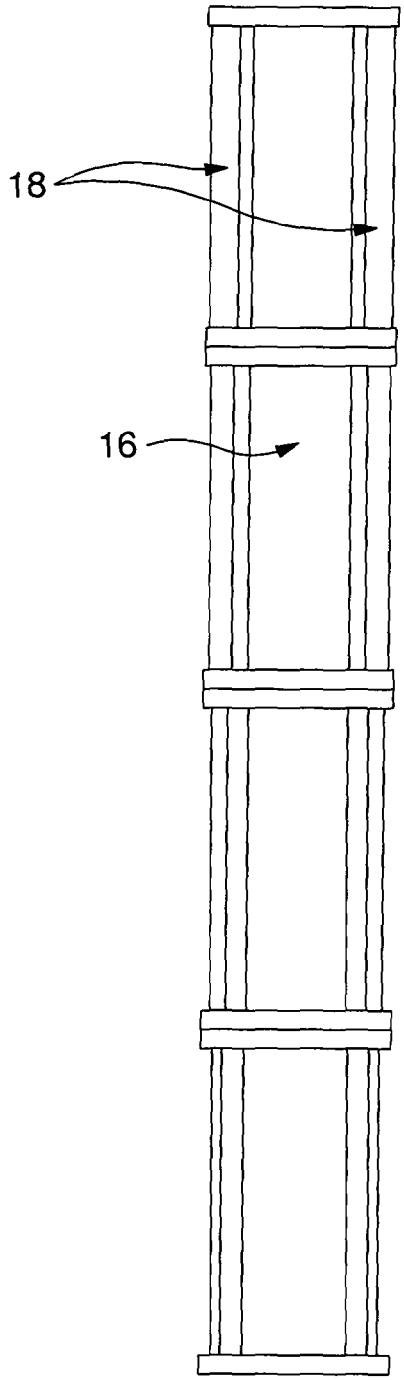
FIG. 6 is an illustration of a drilling riser system in accordance with an alternative embodiment of the present invention.

In the riser system 10 first illustrated in FIG. 1 the auxiliary conduits 18 are of uniform construction. However, in other embodiments the auxiliary conduits 18 may vary in construction, for example along their length. Such variation in the auxiliary conduits 18 may be intended to tailor the riser system more closely with operational conditions. For example, during use an upper region of a riser system will be exposed to greater weight than a lower region. The present invention may tailor a riser system to such conditions by, for example, varying the axial construction of one or more auxiliary conduits such that upper regions are capable of supporting greater axial tension and associated strains than lower regions. An exemplary embodiment of such variation is illustrated in FIG. 6, in which upper regions of an auxiliary conduit 18 include a thicker wall than lower regions.

In other embodiments such variation may be achieved by a variation in the construction of the composite material.

Further, other conditions may be accommodated. For example, it will be recognised that lower auxiliary conduit regions will be subject to larger local pressure forces due to increased water depths. As such, lower regions of an auxiliary conduit may be configured to resist larger hoop forces than upper regions.

The primary conduit of a riser system may also include similar constructional variations to be more closely tailored to specific conditions.

As noted above, each adjacent auxiliary conduit section 18*a* is connected relative to each other at the connecting portion via respective interface assemblies 23. There are a number of possible arrangements of such interface assemblies 23, some of which will be described below.

Figure 7:
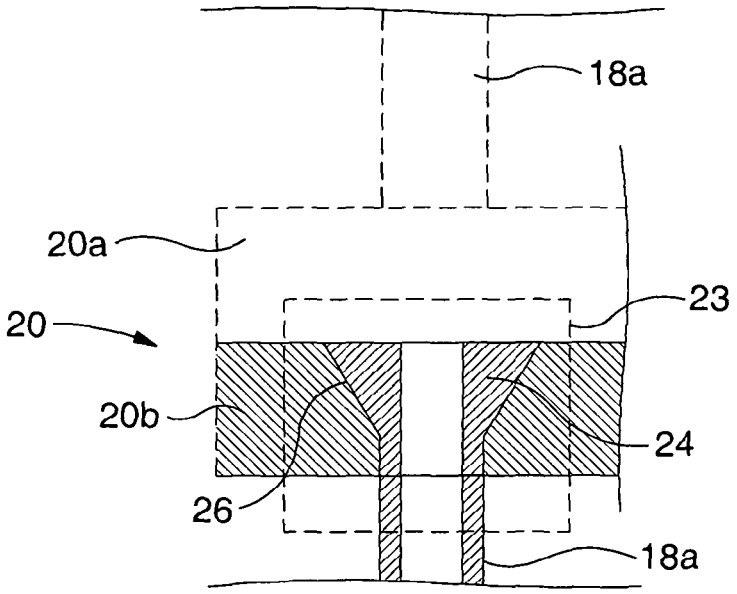
FIG. 7 is an enlarged longitudinal cross-sectional view in the region of a connection portion/interface assembly of a riser system in accordance with an embodiment of the present invention.

One such exemplary interface assembly or arrangement 23 is shown in FIG. 7, which is a cross-sectional view of the riser system 10 in the region of a connecting portion 20. It should be noted that connection of each adjacent auxiliary conduit section 18*a* may be achieved using the same form of connection or interface assembly, or via different connection or interface assemblies. To demonstrate this possibility only an interface assembly 23 associated with a lower auxiliary conduit section 18*a* and corresponding connecting portion 20*b* are illustrated in any detail; the upper conduit section 18*a* and connecting portion 20*a* are simply shown in broken outline.

In this embodiment the end region of the lower auxiliary conduit section 18*a* extends through flange component 20*b*. A wedge or conical profiled portion 24 is defined on the end of the auxiliary conduit section 18*a* which is received within a corresponding profile 26 formed within flange component 20*b*. As such, the flange component 20*b* and connecting portion 20 define integral parts of the interface assembly 23. In the illustrated embodiment the wedge profiled portion 24 is integrally formed with the end of the conduit 18*a*. In this way, the auxiliary conduit section 18*a* may be robustly secured at the connecting portion 20. Further, this arrangement can permit the auxiliary conduit section 18*a* to transmit a load, such as a tensile load, between respective flange components 20*a*, 20*b* of a riser joint 22.

As the wedge portion 24 is to be captivated by the profile 26 formed in the lower connecting portion 20*b*, the lower conduit section 18*a* will be installed by being inserted through the connecting portion 20*b* from above. The opposite end of the auxiliary conduit 18*a* may be secured to a lower connecting portion 20 (not shown in FIG. 7) via an appropriate further interface assembly, examples of which will be described later. It should be understood that any further interface assembly might also need to be passed through the lower connector 20*b* shown in FIG. 7 and dimensional considerations in this regard may need to be taken into account.

Although not illustrated, a sealing arrangement may be provided between the flange components 20*a*, 20*b* and/or the conduit sections 18*a*. Also, in some embodiments the composite material of the auxiliary conduit sections 18*a* may permit inherent compliance upon engagement together to provide appropriate sealing.

Figure 8:
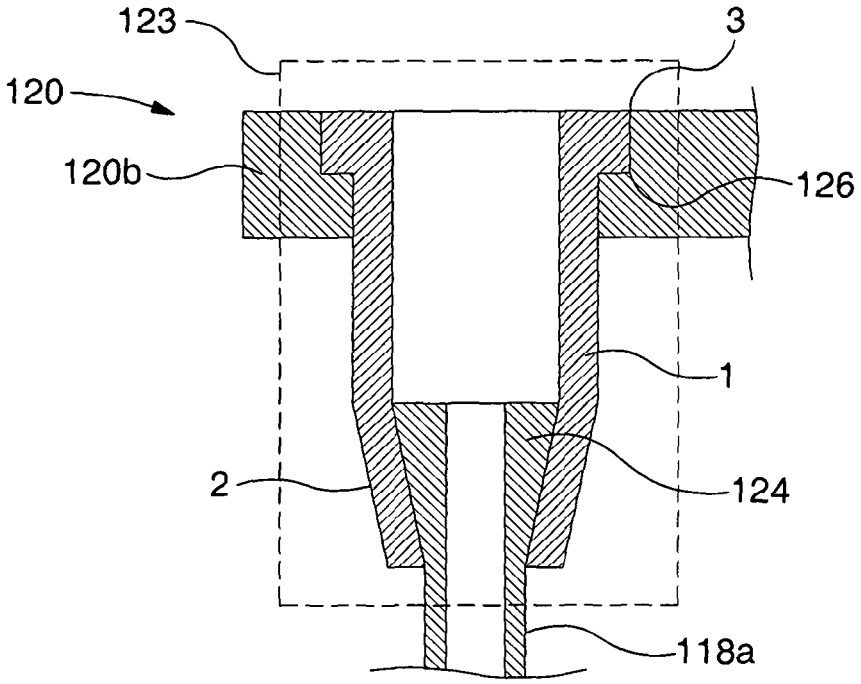
FIG. 8 is an enlarged view of a portion of a connection portion/interface assembly of as riser system in accordance with an alternative embodiment of the present invention.

In the embodiment shown in FIG. 7 the end one or both auxiliary conduits 18*a* extend through the respective flange components 20*a*, 20*b* and are captivated within an appropriate profile 26. However, in other embodiments the ends of at least one auxiliary conduit may be secured externally of the flange components. Such an embodiment is shown in FIG. 8, which is generally similar to the arrangement shown in FIG. 7 and as such like components share like reference numerals, incremented by 100. It may be the case that each flange component includes a different type of association or engagement with a respective auxiliary conduit section. Accordingly, only a single flange component 120*b* is illustrated in FIG. 8.

As in the embodiment shown in FIG. 7, the interface assembly 123 of FIG. 8 also generally includes a profile 124 formed in the end of an auxiliary conduit section 118*a*, and a profile 126 formed in the associated flange component 120*b*. However, in the present interface assembly 123 an interface component 1 is provided which is interposed between the auxiliary conduit section 118*a* and flange component 120*b*. Specifically, the interface component 1 includes a first profiled portion 2 which captivates the profiled end 124 of the auxiliary conduit section 118, and a second profiled portion 3 which is engaged and captivated within the profile 128 in the flange component 120*b*.

Figure 9:
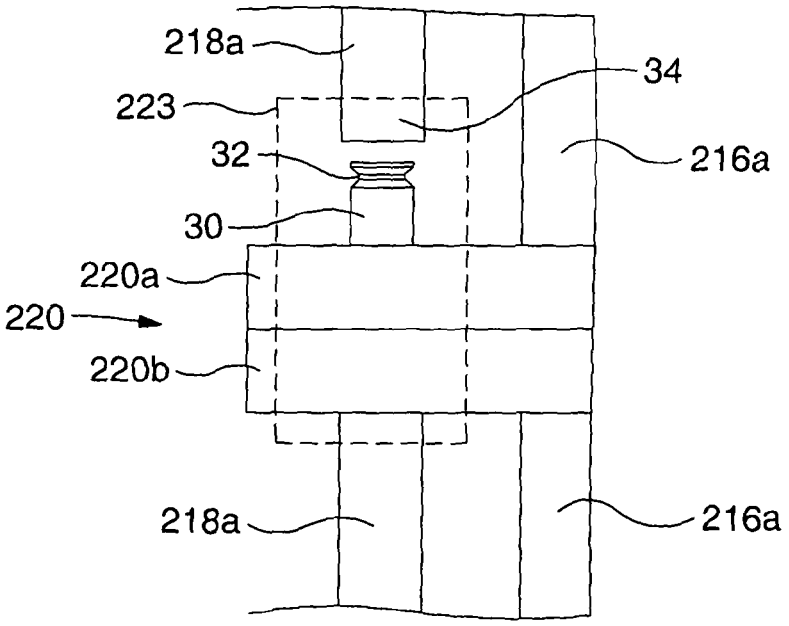
FIG. 9 is an enlarged view of a portion of a connection portion/interface assembly of a riser system in accordance with a further alternative embodiment of the present invention.

An alternative interface assembly 223 is shown in FIG. 9, reference to which is now made. The general arrangement shown in FIG. 9 is similar to that shown in FIG. 7 and as such like components share like reference numerals, incremented by 200. Thus, a connecting portion 220 is composed of a pair of flange components 220*a*, 220*b* which permit primary conduit sections 216*a* and auxiliary conduit sections 218*a* to be coupled together. Each flange component 220*a*, 220*b* comprises an interface component 30 which forms part of the interface assembly 223 (the upper auxiliary conduit section 118*a* is shown disconnected to illustrate the interface component 30). The interface component 30 comprises a quick connect profile 32 which may engage a corresponding profile within the end 34 of the auxiliary conduit section 218*a*. In this respect the corresponding profile within the auxiliary conduit section 218*a* may be integrally formed therewith, or alternatively may be provided on a separate component which itself is secured to the end 34 of said conduit section 218*a*. The end 34 may define an adaptor portion configured to permit connection of the auxiliary conduit sections 218*a* to conventional or existing connections. Furthermore, in the illustrated embodiment the interface component 30 is defined as a male component which is received within a female end 34 of an auxiliary conduit section 218*a*. However, in other embodiments the interface component may define a female socket configured to receive a male portion formed on the end 34 of the auxiliary conduit section 218*a*, for example in the form of a stab-in type connector.

In the embodiment shown in FIG. 9, the connected flange components 220*a*, 220*b* of the connecting portion 220 may define an internal flow path configured to fluidly couple adjacent (upper and lower) auxiliary conduit sections 218*a*. Such an internal flow path may form part of the interface assembly 223.

Figure 10:
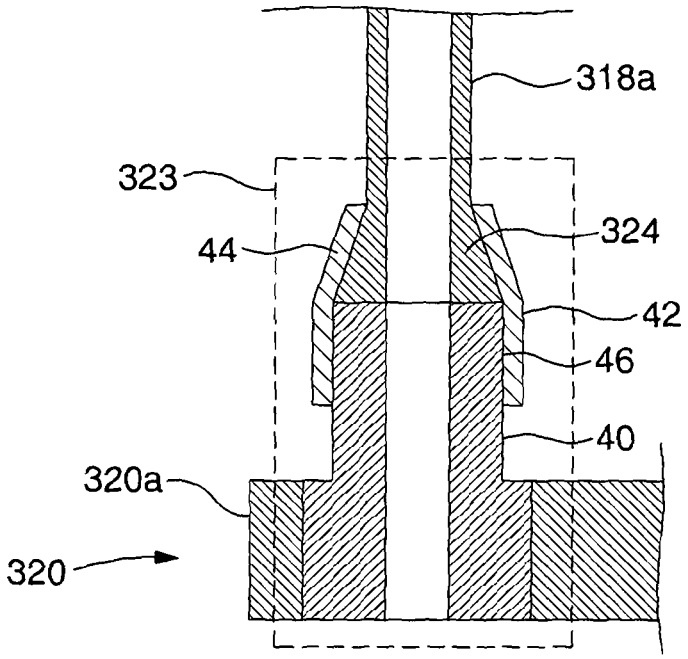
FIG. 10 is an enlarged view of a portion of a connection portion/interface assembly of a riser system in accordance with a still further alternative embodiment of the present invention.

The embodiment shown in FIG. 9 provides a quick-type connection for the auxiliary conduit 218*a*. However, other types of connection may be possible, such as illustrated in the embodiment shown in FIG. 10. In this respect FIG. 10 provides an enlarged view in the region of an interface assembly 323, which includes, at least, a portion of a flange component 320*a* of a connecting portion 320. It should be noted that the arrangement shown in FIG. 10 is generally similar to that shown in FIG. 7 and as such like components share like reference numerals, incremented by 300.

The interface assembly 323 includes an interface component 40 which is secured to the flange component 320*a*, for example by a threaded connection, interference fit, welding, integrally forming or the like. The end of an associated auxiliary conduit section 318*a* includes a profiled region 324. The assembly 323 further includes a collar 42 which defines a captive profile 44 at one end for captivating the end profile 324 of the auxiliary conduit section 318*a*, and a thread 46 at an opposite end for threadably engaging with the interface component 40. Accordingly, the collar 42 may be used to secure the conduit section 318*a* to the interface component 40. Furthermore, the threaded connection between the collar 42 and interface component 40 may permit a degree of tension, such as pre-tension, to be established within the auxiliary conduit section 318*a*.

Figure 11:
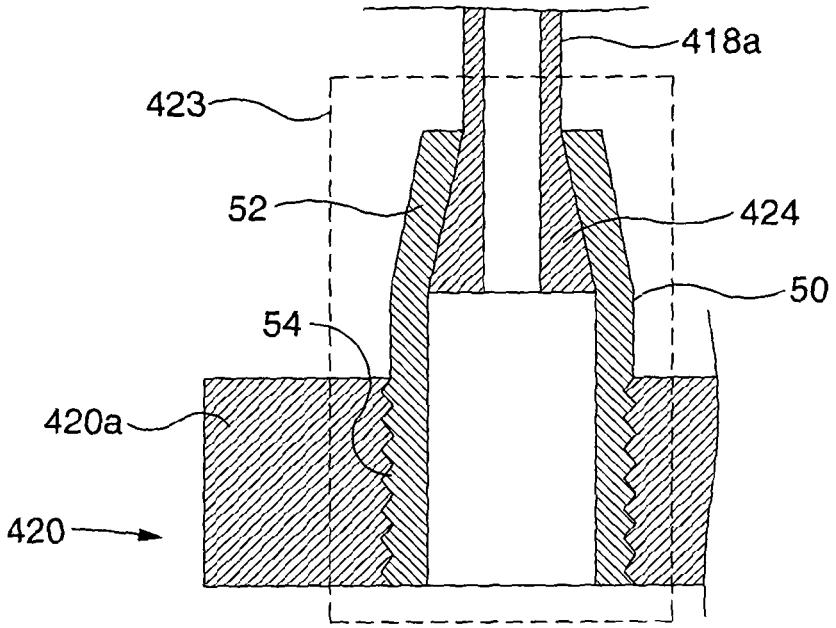
FIG. 11 is an enlarged view of a portion of a connection portion/interface assembly of a riser system in accordance with another alternative embodiment of the present invention.

In an alternative embodiment the functionality of the interface component 40 and collar 42 shown in FIG. 10 may be provided by a single component. Such an arrangement is shown in FIG. 11, which is similar in many respects to the arrangement shown in FIG. 7 and as such like features share like reference numerals, incremented by 400. In this embodiment the interface assembly 423 comprises an interface component 50 which includes a captive profile region 52 which engages and captivates a profile 424 formed on the end of an auxiliary conduit section 418*a*. An opposite end of the interface component 50 comprises a thread portion 54 to permit a threaded connection with flange component 420*a*. Such a threaded connection may permit the interface component 50 to establish tension within the auxiliary conduit section 418*a*.

Figure 12:
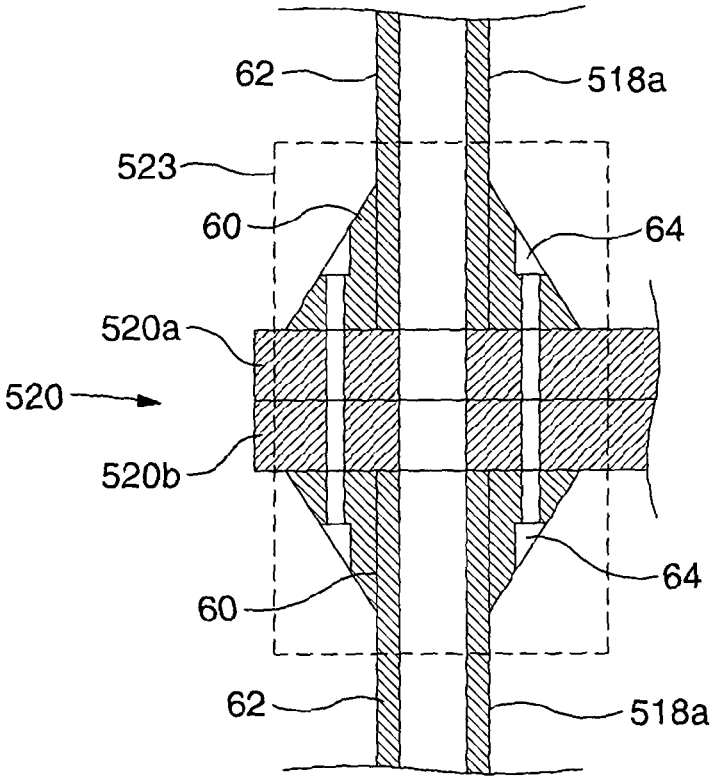
FIG. 12 is an enlarged view of a portion of a connection portion/interface assembly of a riser system in accordance with a further alternative embodiment of the present invention.

A further alternative embodiment of an interface assembly 523 is illustrated in FIG. 12, reference to which is now made. The arrangement in FIG. 12 is generally similar to that shown in FIG. 7 and as such like components share like reference numerals, incremented by 500. Thus, a connecting portion 520 is composed of a pair of flange components 520*a*, 520*b* which permit primary conduit sections (not illustrated) and auxiliary conduit sections 518*a* to be coupled together. The end of each adjacent auxiliary conduit section 518*a* includes an integrally formed composite connecting profile 60 (the connecting profile could alternatively be a separate component) which permits the end regions 62 of the auxiliary conduit sections 518*a* to be connected to a respective flange component 520*a*, 520*b*. In the illustrated embodiment each connecting profile 60 comprises a number of holes 64 for permitting a bolted connection with an associated flange component 520*a*, 520*b*.

It should be understood that a combination of interface assemblies may be utilised. For example, an interface assembly similar to that shown in FIG. 7 or 8 may be present at an upper connecting portion, and an interface assembly similar to that shown in FIGS. 10 and 11 may be present at a lower connecting portion, or vice versa.

Figure 13:
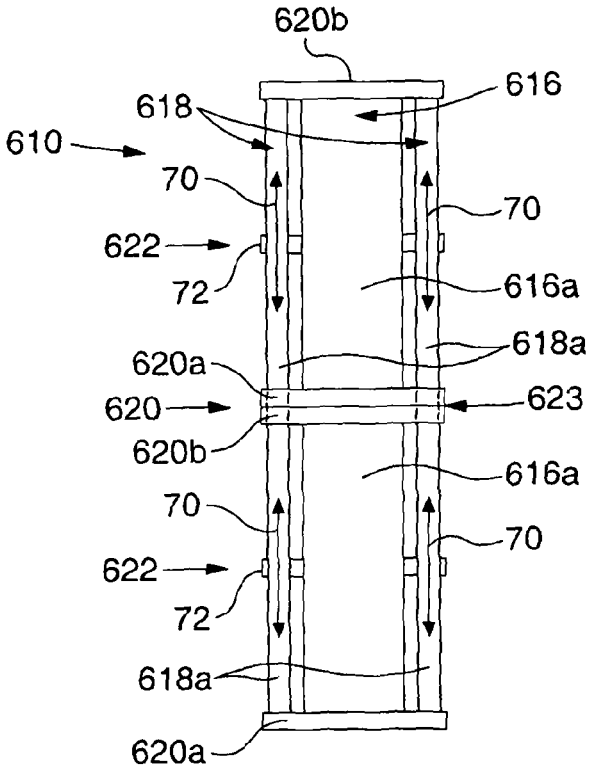
FIG. 13 is an illustration of a riser system in accordance with another embodiment of the present invention.

The embodiments described above provide a rigid connection between the primary and auxiliary conduits within a riser system. Such a rigid connection may provide advantages such as permitting the auxiliary conduits to load share with the primary conduit, to allow the auxiliary conduits to be pre-tensioned and the like. However, in other embodiments such a connection may be compliant. For example, while a general connection, or at least an association, may exist between primary and auxiliary conduits, this may permit relative movement of said conduits in one or more planes or directions, as will be demonstrated below, initially with reference to FIG. 13 which illustrates a portion of a riser system, generally identified by reference numeral 610.

The riser system includes a primary conduit 616 and a plurality of auxiliary conduits 618 which run axially alongside the primary conduit. As illustrated by arrows 70 the auxiliary conduits 618 are permitted to move axially, or float, relative to the primary conduit 616.

The riser system 610 is formed from a plurality of riser joints 622 which are secured together in end to end relation at a connecting portion 620. Each riser joint 622 includes a discrete primary conduit section 616*a* and a plurality of discrete auxiliary conduit sections 618*a*, wherein each conduit section 616*a*, 618*a* extends between opposing flange components 620*a*, 620*b*. Opposing flange components 620*a*, 620*b* of adjacent riser joints 622 are connected together to define respective connecting portions 620. A clamping arrangement 72 is provided intermediate individual flange components 620*a*, 620*b* of each riser joint 622 and functions to clamp or retain the auxiliary conduit sections 618*a* within proximity to the primary conduit section 616*a*.

A form of connection or interface assembly 623 is provided between adjacent auxiliary conduit sections 618*a* generally in the region of the connecting portions, wherein the interface assemblies 623 permit relative axial movement of adjacent and connected auxiliary conduit sections 618*a*. Many different forms of such an interface assembly is possible within the scope of the present invention and some example embodiments are presented below.

Figure 14:
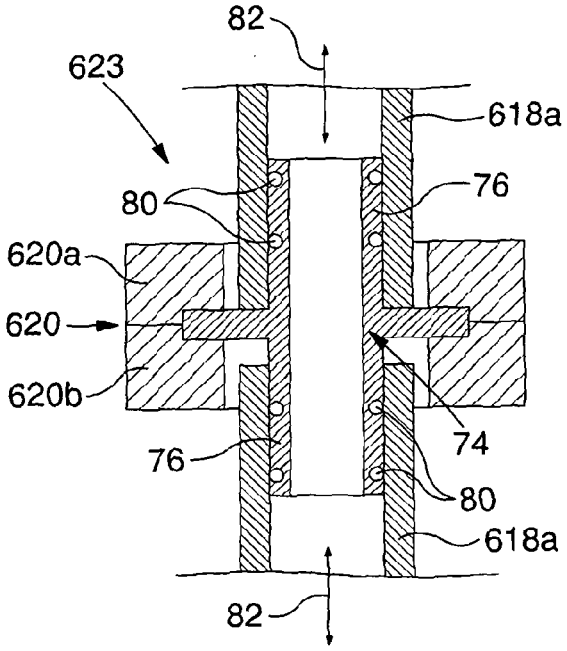
FIGS. 14 to 17 are enlarged views of a portion of a connection portion/interface assembly which may be suitable for use in the riser system of FIG. 13 in accordance various embodiments of the present invention.

Such an example interface assembly 623 is illustrated in FIG. 14, wherein the assembly includes an interface component 74 comprising respective tubular spigot portions 76 located on opposing sides of a flange 78, creating a general double top-hat profile. In the present embodiment the flange 78 is clamped between opposing flange components 620*a*, 620*b* of the connecting portion 620. However, such a connection may not be required.

Each tubular spigot portion 76 is received within the end of a respective auxiliary conduit section 618*a* with sealing being achieved via seals 80. The arrangement is such that a telescoping movement, illustrated by arrows 82, between the auxiliary conduit sections 618*a* and respective spigot portions 76 is permitted, providing a degree of relative axial movement between the adjacent conduit sections 618*a*.

Figure 15:
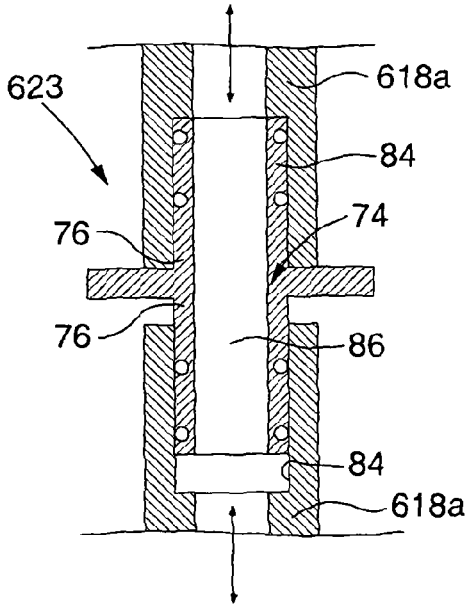

In the embodiment illustrated in FIG. 14 the interface component 76 represents a restriction in internal diameter relative to the auxiliary conduit sections 618*a*. However, in other embodiments such a restriction may be avoided or minimised, for example as illustrated in FIG. 15 which shows a slightly modified interface assembly, shown removed or isolated from a connecting portion (although it should be clear that any interface assembly may be located remotely from a connecting portion). In view of the significant similarities between the embodiments shown in FIGS. 14 and 15, like components share like reference numerals. As such, in FIG. 15 the interface assembly is also identified by reference numeral 623 and includes an interface component 74 having opposing tubular spigot portions 76 to be received in a sliding manner within the ends of respective auxiliary conduit sections 618*a*. However, in the present embodiment the ends of the auxiliary conduit sections 618*a* include enlarged diameter regions 84 which receive the respective spigot portions 76 to permit a more uniform internal bore 86 to be created.

Figure 16:
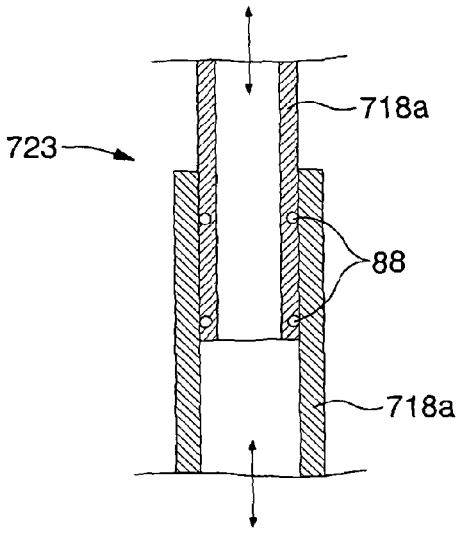

In other embodiments the use of a separate interface component, such as illustrated in FIGS. 14 and 15, may not be required. For example, it may be possible for the ends of adjacent auxiliary conduit sections to be directly engaged, for example in a telescoping manner. Such an interface assembly 723 is illustrated in FIG. 16, wherein the end of one auxiliary conduit section 718*a* (the upper conduit in this example) is inserted within the end of an adjacent auxiliary conduit section 718*a* (the lower conduit in this example) with sliding seals 88 provided therebetween.

Figure 17:
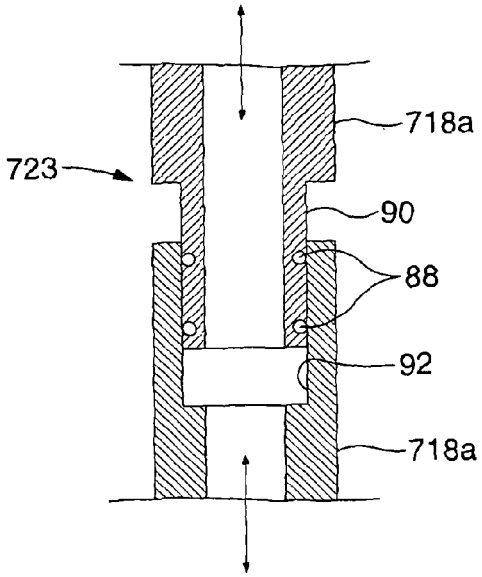

In a similar manner to that described above with reference to FIG. 15, arrangements may be made to permit a more uniform internal diameter to be retained. Such arrangements are disclosed in FIG. 17, where the end of one auxiliary conduit section 718*a* (the upper section in this example) includes a reduced outer diameter section 90, and the end of the other auxiliary conduit section 718*a* (the lower section in this example, includes an enlarged internal diameter region 92.

Figure 18:
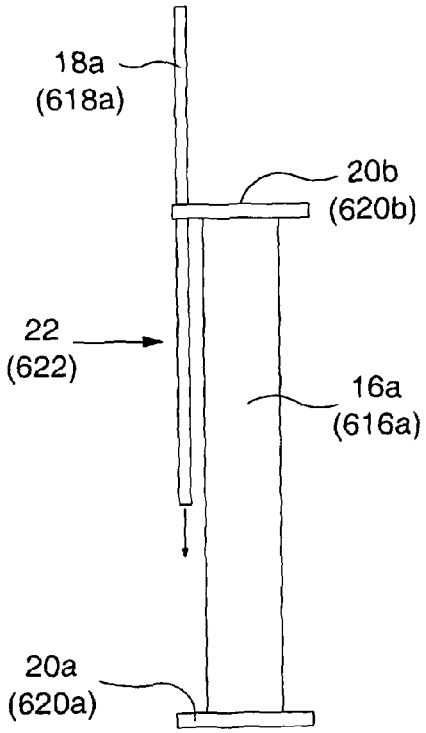
FIG. 18 provides an illustration of a method of installing an auxiliary conduit relative to a primary conduit.
Figure 19:
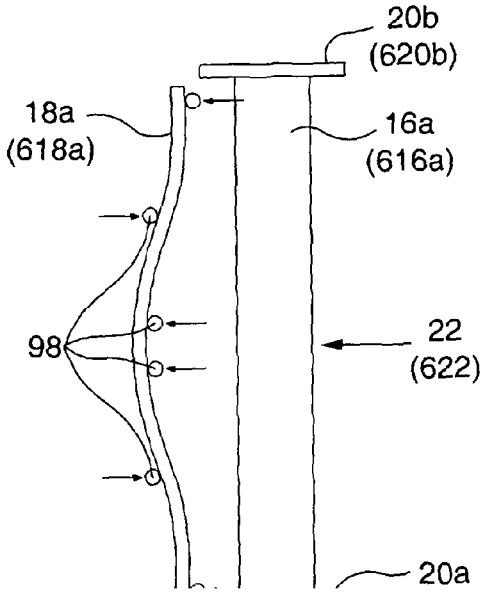
FIG. 19 provides an illustration of an alternative method of installing an auxiliary conduit relative to a primary conduit.

In various embodiments described above, such as with reference to FIGS. 2 and 13, a riser joint 22 (622) generally includes a primary conduit section 16*a* (616*a*) and a number of auxiliary conduit sections 18*a* (618*a*) secured between opposing flange components 20*a* (620*a*), 20*b* (620*b*). FIGS. 18 and 19 provide illustrations of alternative embodiments for installing an auxiliary conduit section 18*a* (618*a*) relative to opposing flange components 20*a* (620*a*), 20*b* (620*b*).

Referring initially to FIG. 18, an auxiliary conduit section 18*a* (618*a*) may be axially inserted through the upper (or lower in other embodiments) flange component 20*b* (620*b*).

Alternatively, as shown in FIG. 19, an auxiliary conduit section 18*a*, (618*a*) may be longitudinally deformed to reduce its axial envelope length using a deforming apparatus 98. While in this deformed state the auxiliary conduit section 18*a* (618*a*) may be located between the flange components 20*a* (620*a*), 20*b* (620*b*) and subsequently relaxed to then be retained between said flange components. In such an arrangement the composite material of the auxiliary conduit section 18*a* (618*a*) may permit such longitudinal deformation or bending to be achieved by the apparatus 98 without causing damage or creating significant stress within the conduit, and also permit substantially complete elastic recovery when relaxed during insertion between the flange components.

It should be understood that the embodiments described herein are merely exemplary and that various modifications may be made thereto. For example, the riser system is not limited for use as a drilling riser system. Furthermore, the principles of the invention need not only be applied to riser systems, and may be utilised within conduit systems which comprise multiple individual conduits running alongside each other.

Furthermore, in the embodiments described above the auxiliary conduits are established by a number of discrete conduit sections joined together at the connecting portions. However, in other embodiments a continuous length of auxiliary conduit may be provided. In such an arrangement the continuous conduit may extend through a connecting portion, for example through a suitably dimensioned throughbore or the like.

Many different embodiments of connection or interface between auxiliary conduit sections has been presented. However, any suitable combination of such embodiments may also be possible. For example, one end of an auxiliary conduit section may be associated with one type or form of connection or interface, whereas an opposite end may be associated with a different type or form of connection or interface.

The invention claimed is:

1. A riser system configured to be secured between a surface vessel and a subsea location, said system comprising:

a continuous unitary primary conduit; and a continuous unitary auxiliary conduit extending adjacent the primary conduit and comprising a composite material formed of at least a matrix and one or more reinforcing elements embedded within the matrix, wherein the primary and auxiliary conduits are connected together at an axial location along the riser system via a connecting portion, said auxiliary conduit being pre-tensioned relative to the connecting portion.

2. The riser system according to claim 1, comprising or defining a drilling riser system.

3. The riser system according to claim 1, wherein the primary and auxiliary conduits are rigidly connected together at or via the connecting portion to prevent or restrict relative movement of the auxiliary and primary conduits in at least one plane or direction at the connecting portion.

4. The riser system according to claim 3, wherein rigidly connecting the primary and auxiliary conduits permits load transference between the primary and auxiliary conduits across the connecting portion.

5. The riser system according to claim 1, wherein the auxiliary conduit at least partially supports the weight of the primary conduit.

6. The riser system according to claim 1, wherein the auxiliary conduit is pretensioned relative to the connecting portion to establish pre-compression within the primary conduit.

7. The riser system according to claim 1, comprising a plurality of connecting portions permitting the auxiliary conduit to be connected relative to the primary conduit at multiple points along the length of the riser system.

8. The riser system according to claim 7, wherein the auxiliary conduit is pre-tensioned between two axially spaced connecting portions.

9. The riser system according to claim 1, comprising a plurality of continuous unitary auxiliary conduits circumferentially distributed about the primary conduit.

10. The riser system according to claim 9, wherein the plurality of auxiliary conduits are evenly circumferentially distributed about the primary conduit.

11. The riser system according to claim 1, wherein the primary conduit comprises a composite material formed of at least a matrix and one or more reinforcing elements embedded within the matrix.

12. The riser system according to claim 11, wherein the primary and auxiliary conduits comprise a similar composite material.

13. The riser system according to claim 1, wherein at least the auxiliary conduit comprises a variation along a length of the auxiliary conduit.

14. The riser system according to claim 13, wherein at least one axial portion of the auxiliary conduit varies relative to a different axial portion of the auxiliary conduit.

15. The riser system according to claim 13, wherein at least the auxiliary conduit comprises a variation in axial load carrying capacity or specification along the length of the auxiliary conduit.

16. The riser system according to claim 13, wherein an upper region of the auxiliary conduit is configured to accommodate greater axial load than a lower region of the auxiliary conduit.

17. The riser system according to claim 1, wherein at least the auxiliary conduit comprises a wall comprising the composite material, wherein the wall comprises or defines a local variation in construction to provide a local variation in a property of the auxiliary conduit.

18. A method for forming a riser system to be secured between a surface vessel and a subsea location, comprising:

providing a continuous unitary primary conduit;

extending a continuous unitary auxiliary conduit adjacent the primary conduit, wherein the auxiliary conduit comprises a composite material formed of at least a matrix and one or more reinforcing elements embedded within the matrix;

connecting the primary and auxiliary conduits together at an axial location along the riser system via a connecting portion; and pre-tensioning the auxiliary conduit relative to the connecting portion.

* * * * *